United States Patent [19]

Kakinuma

[11] 4,050,159

[45] Sept. 27, 1977

[54] HEM-LINE MARKER

[76] Inventor: Toshihide Kakinuma, No. 2-43, Kamiya Kita-ku, Tokyo, Japan

[21] Appl. No.: 664,788

[22] Filed: Mar. 8, 1976

[30] Foreign Application Priority Data

Mar. 13, 1975 Japan ..... 50-29531

[51] Int. Cl.[2] ..... A41H 9/02

[52] U.S. Cl. ..... 33/9 R

[58] Field of Search ..... 33/9 R, 10

[56] References Cited

U.S. PATENT DOCUMENTS

| | | | |
|---|---|---|---|
| 846,149 | 3/1907 | Scully | 33/10 |
| 2,659,147 | 11/1953 | Halpin et al. | 33/9 R |
| 2,700,824 | 2/1955 | Reich | 33/9 R |
| 3,662,931 | 5/1972 | Arthur et al. | 33/9 R |

*Primary Examiner*—Charles E. Phillips
*Attorney, Agent, or Firm*—Michael J. Striker

[57] ABSTRACT

A hem-line marker used with needles having a head portion and a shank portion, having a base having an upright, clamping means mounted on and slidable along the upright for clamping a portion of the cloth of a garment, pin storing and feeding means for feeding pins to an inserting position, and pin inserting means for inserting pins into the clamped cloth portion.

7 Claims, 13 Drawing Figures

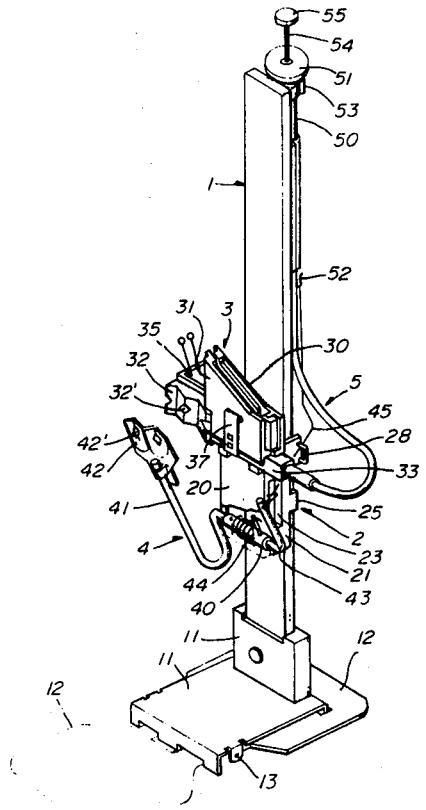

HEM-LINE MARKER

BACKGROUND OF THE INVENTION

The present invention relates to a hem-line marker, and in particular to a device which can be used by a user to make one or more marks at the lower hem region of a garment —such as a skirt, a dress, a coat or the like —even while the user is wearing the garment, without requiring the help of another person.

The home seamstress usually determines the sizes of various parts of a garment to be sewn, by reference to a pattern. However, to assure proper fit, it is desirable to finally determine the hem line of the skirt of a garment in such a manner while actually weaving the garment, in preparation for the final length-fitting of the garment. Prior-art devices have been produced to permit the seamstress to do this without the aid of another persion; however, these prior-art devices are difficult for the user to operate herself, because of the complicated structure and bulkiness thereof. These devices of prior art therefore, have not been suitable as an instrument for home sewing.

SUMMARY OF THE INVENTION

This invention has been devised to remove the shortcomings of the prior art.

It is a basic object of the present invention to provide a skirt marker which is easy to operate and enables the user thereof to make desired markings by herself without requiring the help of another person.

A more specific object of the invention is to provide such a skirt marker which has one controlling part to which all the operating parts are centralized.

Still another object of the invention is to provide a skirt marker of simple and reliable structure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIGS. 5A to 7B are respectively front and plan views of a pin feeding mechanism of the invention, shown with some parts omitted and with some parts in section;

Figure 2:
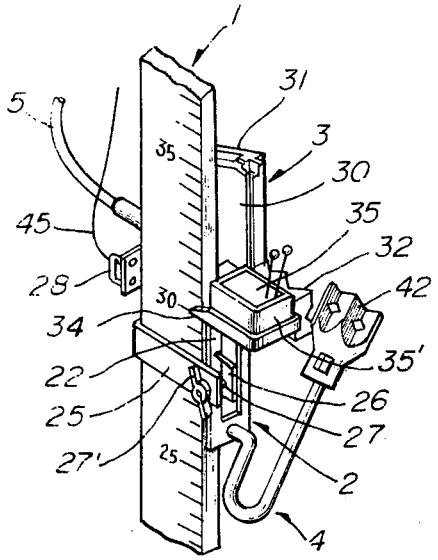
FIG. 2 is a partial perspective view, showing the opposite side of the device in FIG. 1.
Figure 1:
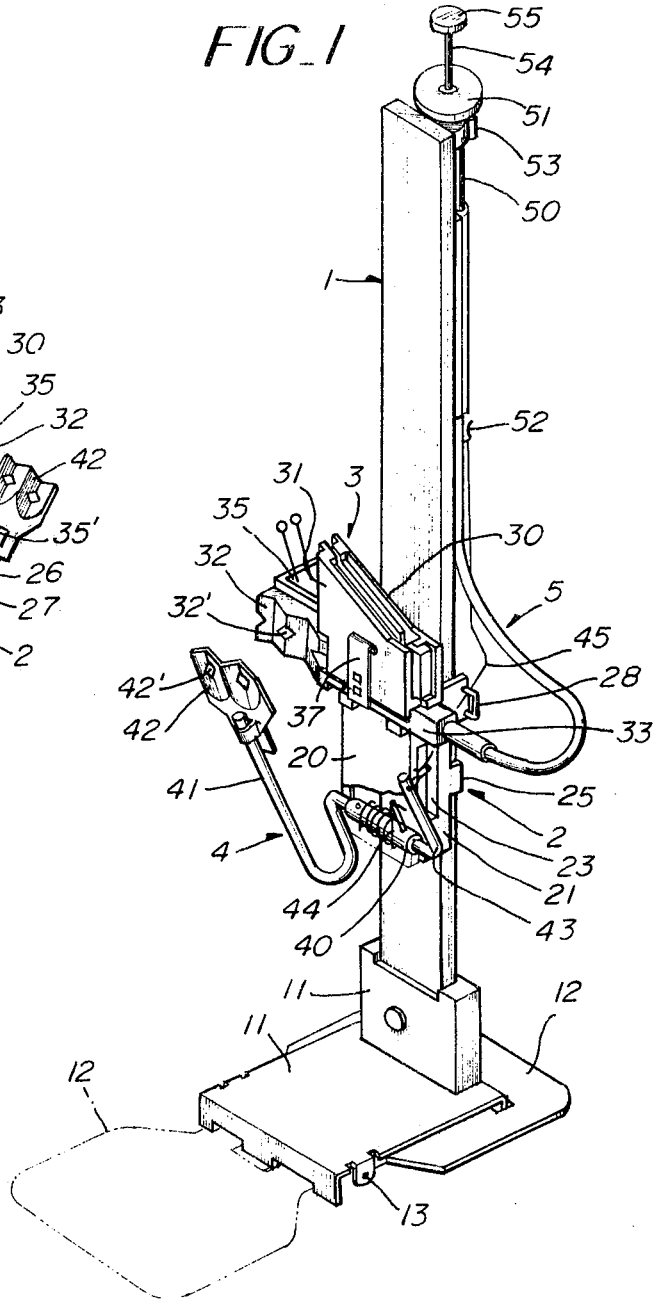
FIG. 1 is a perspective view of a hem marker according to the invention, partly broken away to show details.
Figure 3:
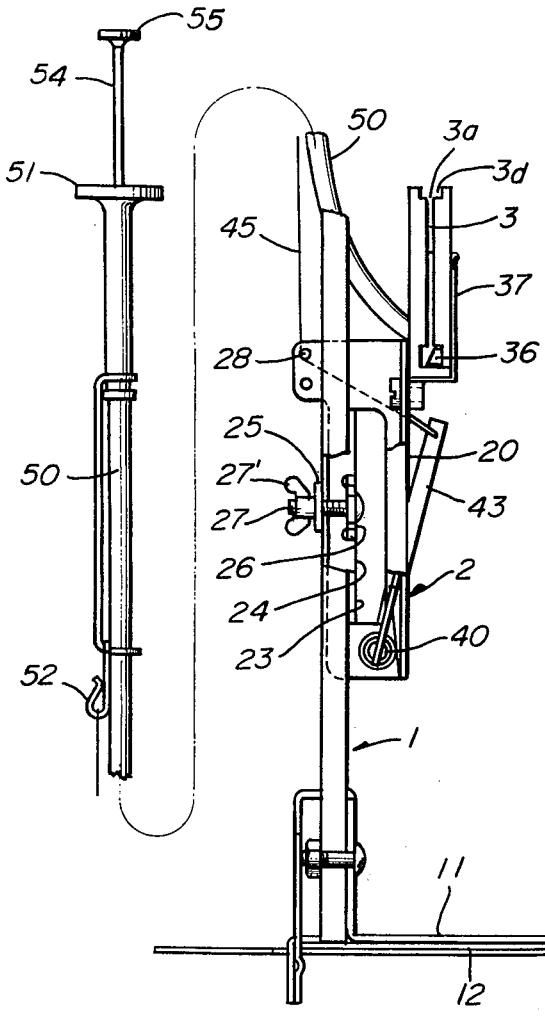
FIG. 3 is a side elevational view of the invention, again partly broken away.

DESCRIPTION OF A PREFERRED EMBODIMENT:

Referring firstly to FIGS. 1, 2 and 3, reference numeral 1 is a vertical elongated scale or member or upright on which a sliding body 2 is slidably mounted so that it can be retained at any optional position along the scale of member 1. A pin feeding mechanism 3 is provided on the sliding body 2 for feeding hem marking pins vertically accumulated therein. A cloth pressing mechanism 4 is turnably mounted on body 2 and a pin discharging mechanism 5 is connected to the pin feeding mechanism 3 for discharging the pins from the pin feeding mechanism 3.

Figure 10:
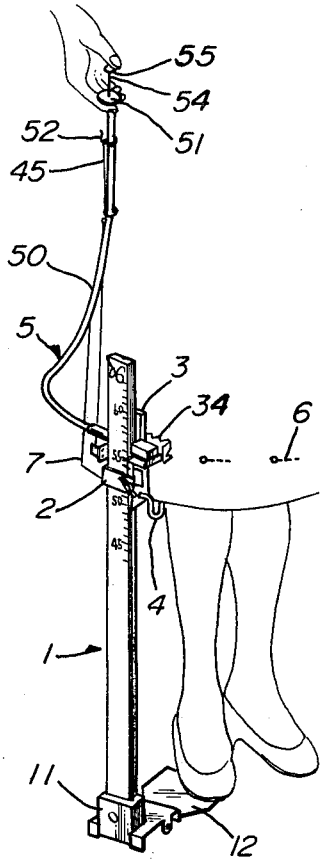
FIG. 10 is a perspective view of the hem marker according to the invention, showing the manner in which it is employed by the user.

As FIG. 1 shows, the elongated scale member 1 is supported in vertical orientation on a stand 11. A base 12 has its one end turnably mounted on a pivot 13 of the stand 11 at the underside of the latter, so that it can be folded beneath and next to the stand 11 as shown by the solid-line and the phantom-line positions in FIGS. 1 and 3. When the marker is used, the base is moved to the phantom-line position shown in FIG. 1 so that, when the user puts one foot on the plate 12, the scale member 1 is fixed and stabilized; this is shown in FIG. 10.

The sliding body 2 is shaped so as to embrace the scale member 1, being a stamped and pressed member composed of flat plate 20 which supports the pin feeding mechanism 3, lateral bent portions 21 and 22 at both sides of the flat plate 20 and engaging both sides of the scale member 1 as shown in FIGS. 1 and 2, additional bent portions 23, 24 at both sides of the flat plate 20 and engaging one face of the scale member 1 as shown in FIGS. 1 and 3, and a final pair of bent portions 25, 26 at one side of the flat plate 20 for clamping the scale member 1 as shown in FIG. 2. The sliding body 2 is slidably mounted on the scale member 1 by means of a screw 27 which passes through the clamping portions at the free end thereof and meshes with a nut 27' (FIG. 3). On the upper part of the flat plate 20 of the sliding body 2, the pin feeding mechanism 3 is supported, and on the lower part of the flat plate 20 the cloth pressing mechanism 4 is supported.

Figure 5:
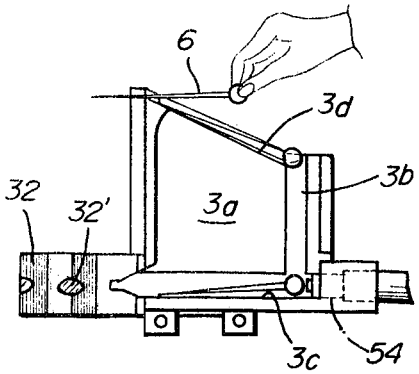
Figure 5:
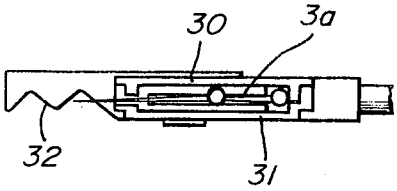
Figure 6A:
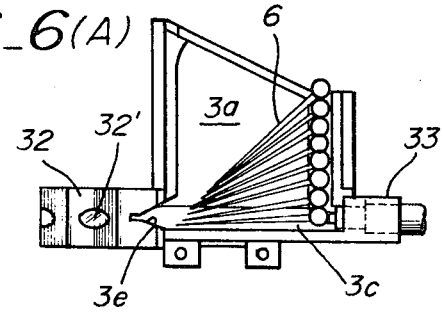
Figure 7A:
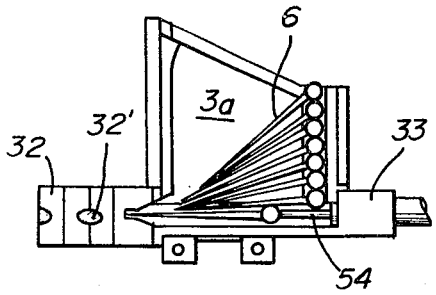

Referring now in more detail to FIGS. 1, 5A, 5B, 6A and 6B, it will be seen that pin staring and feeding means are provided which include the pin feeding mechanism 3 composed of a body forming a chamber 30 for accommodating hemming pins 6 therein in a vertically accumulated position. The chamber 30 has a cover 31. A pin discharging portion 33 is provided at the bottom of the chamber 30 and a corrugated plate 32 holds the cloth to be pinned. The corrugated plate 32 extends laterally from the bottom of the body forming the chamber 30 and is substantially in alignment with the pin discharging portion 33 (FIG. 7A). Corrugated plate 32 is also provided with a lateral groove 32' which is laterally continuous with the interior 3C of the pin discharging portion 33 (FIGS. 5A, 6B).

Figure 6:
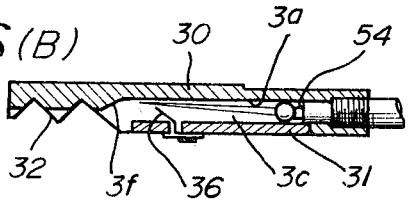
Figure 7B:
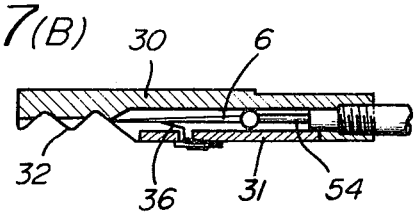

The pin feeding mechanism 3 further includes a scale indexing element 34 and a pin cushion 35 as shown in FIG. 2. The element 34 is bent and extends from the corrugated plate 32 to the graduated face of the scale member 1. Pin cushion 35 is located in a box 35' provided on the corrugated plate 32. The purpose of the cushion 35 is to save thereon the spare pins, as shown in FIG. 2. The body forming the chamber 30 of the pin feeding mechanism 3 is secured to the sliding body 2. In the interior of the pin accommodating chamber 30 a groove **3*a* is provided to allow the passage of the pin shank. A wider groove 3b is provided to allow the passage of the pin head, and a groove 3c allows the passage of both the pin shank and the pin head (FIGS. 5–7). The upper part 3d of the chamber 30 is open for receiving the pins 6 and inclined to one side thereof so that pin 6 may be correctly guided into these grooves 3a–3c**.

Figure 8:
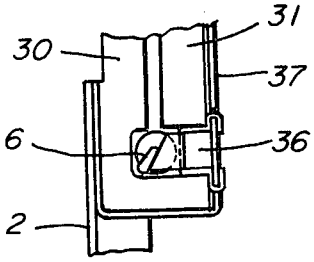
FIG. 8 is a fragmentary side elevation of FIG. 7B.

Pin inserting means includes the pin discharging groove 3c which is provided at the outlet thereof with guide faces 3e and 3f for the pin 6; as shown in FIGS. 6A and 6B. An inclined guide spring 36 (FIGS. 8 and 9) is provided on a part of the cover 31 which forms the groove 3c together with the body defining the chamber 30, so that pin 6 from the chamber 30 may be exactly led to the narrower groove 32' of the corrugated plate 32 in association with the guide faces 3e and 3f. The cover 31 is preferably made of a transparent substance —— e.g., glass or synthetic plastic such as acrylic —— so that the user of the device can observe the inside of the chamber 30; it is secured to the body forming chamber 30 by means of a spring 37 which is fixed to the sliding body 2.

Figure 4:
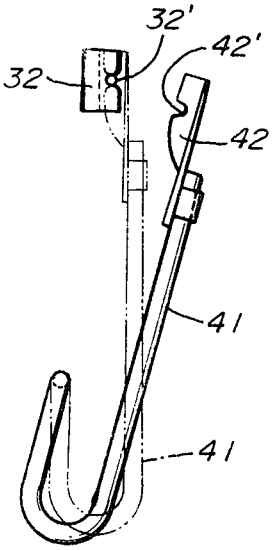
FIG. 4 is an explanatory side view showing the action of a cloth pressing mechanism in the device of the invention.

The cloth pressing mechanism 4 is best shown in FIGS. 1, 2 and 4. It has a lever having an actuating arm 41 and an operating arm 43, and a cloth pressing member or plate 42 (generally speaking a clamping means) which is fixedly mounted on the actuating arm 41 of the lever opposite to the corrugated plate 32 of the pin feeding mechanism 3. The pressing plate 42 is a counterpart of the corrugated plate 32 of the pin feeding mechanism 3 and has a corrugated face provided with openings 42' so that it may form a passage for the pins 6 in conjunction with the groove 32' of the corrugated plate 32 when it is pressed against the latter.

At its intermediate horizontal part connecting the arms 41 and 43 the lever is provided with a cylinder mount member 40 by which the lever is turnably mounted in the sliding body 2 at the lower part thereof. Biasing means, here a coil spring 44, surrounding the mount member 40, normally urges the arm 41 and the cloth pressing plate 42 in a direction away from the pin feeding mechanism 3. An elongated flexible element in form of a wire or a cord 45 has one end connecting to the upper part of the operating arm 43 and its other end is guided by a guide 28 on the sliding body 2 and is connected to a hook 52 on the pin discharging mechanism which, as seen in FIGS. 1, 3 and 10, comprises a release member 5 having elongated an other flexible element in form of a tube 50 with a flange 51 provided on the upper end thereof and a wire 54 with a head or release portion 55 that is inserted into the tube. The lower end of the release member is connected to the groove 3c at the bottom of the pin chamber 30 in which a lowermost pin 6 is positioned with the pin head adjacent to the release end, as shown in FIGS. 1, 5A, 5B, 6A, 6B, 7A and 7B. A support element 53 is fixed to the upper end of the scale member 1 (FIG. 1). This element 53 supports the release member 5 when the same is not in use. Elements 45 and 50 may be considered to be the operating means.

Figure 9:
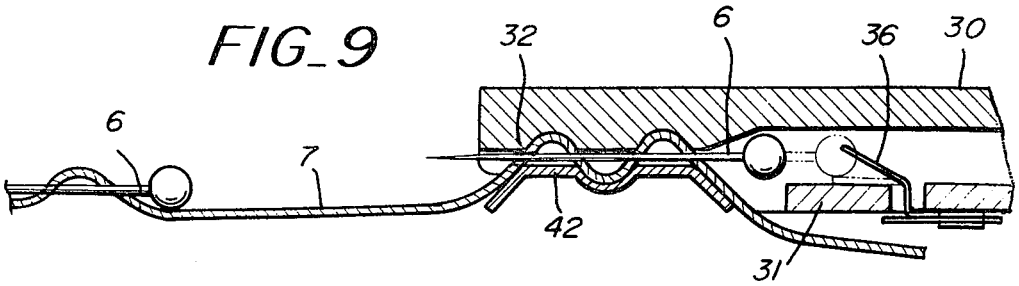
FIG. 9 is a fragmentary cross-section of the pin feeding mechanism in the device of the invention, showing pins discharged and inserted in a cloth.

In operation of the device of the present invention, the base plate 12 is first pivoted out from beneath the stand 11 to the phantom-line position in FIG. 1. The user of the device, who wears a skirt, dress coat or other garment to be measured, places one foot on the plate 12 to steady the device. Now, the sliding body 2 is shifted to a desired height corresponding to a desired hem line to be marked, so as to bring the scale indicator 34 to the corresponding graduation of the scale member 1. Thereupon the edge of the skirt or the like is inserted between the corrugated plate 32 and the cloth pressing plate 42, and the user then stands upright in a natural manner and picks up the release member 5 from the support element 53, as shown in FIG. 10. At this time, the lever 4 is turned by the cord 45 against the action of the spring 44 toward the pin feeding mechanism 3, and a part of the garment cloth is, therefore, pressed against the corrugated plate 32 by the cloth pressing plate 42 as shown in FIG. 9. When the user thereafter pushes the wire head 55 of the release member 5, the pin 6 in the pin discharging groove 3c is discharged and inserted into the waved cloth part that is entrapped between the corrugated plates 32 and 42. If the user then lowers the release member 5, the cloth is released from between the plates 32 and 42. If she turns by a small increment relative to the device, shifting the position of her foot on the plate 12 and then picking up the release member 5 and pushes the wire head 55 again, she can again insert another pin into another part of the garment hem at the same level as that of the preceding pin. As the operation is repeated, the pins 6 vertically accumulatedin the chamber 30 are discharged one by one into the hem of the garment which the user wears. Thus she can make a plurality of marks with the pins all around the skirt and determine a hem line easily, accurately and effectively without requiring the help of another person.

It will be understood that each of the elements described above, or two or more together, may also find a useful application in other types of applications differing from the types described above.

While the invention has been illustrated and described as embodied in a hem marker for garments, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hem-line marker used with needles having a head portion and a shank portion, comprising a base having an upright; clamping means mounted on and slidable along said upright for clamping a portion of the cloth of a garment, said clamping means comprising a clamping member mounted for pivotal movement into and out of a position in which it clamps said cloth portion, and means permanently biasing said member out of said position; pin inserting means for inserting pins at an inserting position into the clamped cloth portion; pin storing and feeding means for feeding pins to said inserting position; operating means for operating said clamping means and said pin inserting means, comprising a first elongated flexible element having one end connected to said pin inserting means and another end provided with a release portion, and a second elongated flexible element having spaced end portions connected to said clamping member and said other end of said first elongated flexible element; and means on said upright for normally detachably holding said other end portion of said first elongated flexible element in an inoperative position in which said second elongated flexible element is stack so that, when a user detaches said other end portion from said holding means and raises said release portion to an operating level higher than the level of said holding means, said second elongated flexible element becomes tensioned and moves said clamping member into said position in which it clamps said cloth portion in preparation for operation of said pin inserting means by actuation of said release portion by a user.

2. A marker as defined in claim 1, wherein said upright is provided with a scale extending longitudinally of the upright.

3. A marker as defined in claim 2, wherein said pin feeding means comprises a chamber having an upper opening for accommodating pins, a first groove communicating with said opening and dimensioned for permitting the passage of needle shank portions, a second groove communicating with said opening and dimensioned for permitting the passage of pin head portions, and a third groove communicating with said opening and dimensioned for permitting the passage of both said shank portions and said head portions.

4. A marker as defined in claim 3, wherein said pin feeding means further comprises a corrugated plate laterally extending from one end of said third groove and formed with a fourth groove for the shank portion of a pin and an indexing element extending from the corrugated plate to the face of the scale where graduations, are provided, said third groove being provided with a guide face and a guide spring which direct the shank portion of a pin in the third groove to the fourth groove of the corrugated plate when the pin is discharged.

5. A marker as defined in claim 4, wherein said first elongated flexible element comprises an elongated tube with a flange at one end thereof, and a wire slidably inserted in said tube and having at one end portion thereof said release portion, said tube being connected at said one end to said third groove of the pin feeding means on that side where the head portion of a pin is located, so that the end portion of said wire which is spaced from said one end portion may push against the head portion of such pin when said release portion is pushed.

6. A marker as defined in claim 5, wherein said clamping means further comprises a lever having an actuating arm at one end thereof and an operating arm at the opposite end thereof, and an intermediate part which is turnably mounted on a support plate of said clamping means, said clamping member being mounted on the actuating arm of the lever opposite said corrugated plate of said pin feeding means, said clamping member being a counterpart of and cooperating with said corrugated plate and having a corrugated face and openings therein for forming with said corrugated plate a passage for the shank portion of a pin.

7. A marker as defined in claim 6, wherein said biasing means comprises a spring for normally urging said lever in a direction away from said pin feeding means whereby said clamping member is held in a position remote from said corrugated plate of said pin feeding means.

* * * * *